United States Patent [19]

Johansen

[11] 4,146,776

[45] Mar. 27, 1979

[54] CEILING MOUNTED FORCED CIRCULATION ELECTRIC AIR HEATER

[75] Inventor: Robert Johansen, Algonquin, Ill.

[73] Assignee: Aubrey Manufacturing, Inc., Union, Ill.

[21] Appl. No.: 739,633

[22] Filed: Nov. 8, 1976

[51] Int. Cl.[2] ..... H05B 3/00; F24H 3/02; F24H 9/00

[52] U.S. Cl. ..... 219/368; 165/125; 219/342; 219/370

[58] Field of Search ..... 219/359, 365, 366–370, 219/371, 375, 376, 342, 361; 165/122, 124, 125

[56] References Cited

U.S. PATENT DOCUMENTS

| | | | |
|---|---|---|---|
| 1,750,094 | 3/1930 | Emmrich | 219/370 UX |
| 1,828,809 | 10/1931 | Landis | 219/368 |
| 1,979,883 | 11/1934 | Hynes | 219/368 X |
| 2,221,703 | 11/1940 | Falco | 165/125 X |
| 2,765,393 | 10/1956 | Theisen | 219/368 X |
| 2,966,573 | 12/1960 | Hansen | 219/368 X |
| 3,223,828 | 12/1965 | Mast | 219/370 |
| 3,831,000 | 8/1974 | Waters et al. | 165/125 X |
| 3,955,065 | 5/1976 | Chambom | 219/368 X |

FOREIGN PATENT DOCUMENTS

| | | | |
|---|---|---|---|
| 948851 | 2/1949 | France | 219/370 |
| 59113 | 12/1953 | France | 219/368 |
| 258801 | 5/1949 | Switzerland | 219/368 |
| 869579 | 5/1961 | United Kingdom | 219/368 |

*Primary Examiner*—A. Bartis
*Attorney, Agent, or Firm*—Alter and Weiss

[57] ABSTRACT

A ceiling mounted forced circulation electric air heater has a housing comprising upper and lower housing members fastenable together at a plurality of tangentially abutting, convex dome-like bosses integrally formed on the housing members. The housing supports a fan and an electric heating element. The housing members define therebetween a circumferentially extending air flow passage providing wide distribution of the air directed through the housing by the fan and heated by the heating element. The bosses provide secure, permanently aligned mating points for the housing members. The housing includes a cover securable to the lower housing member.

6 Claims, 2 Drawing Figures

CEILING MOUNTED FORCED CIRCULATION ELECTRIC AIR HEATER

This invention relates to forced air electric heaters and more particularly to fan operated heating units typically ceiling mounted.

Auxiliary heating devices find particular application wherein an immediate source of heat is required for personal comfort. As an example, such units may typically be installed in bathrooms to quickly and efficiently heat the room without requiring the entire dwelling to be heated. Such units are designed to heat a small area relatively quickly upon actuation. One such heating technique is to provide an electric fan unit which draws air in, passes it over heating elements, and thereafter discharges the heated air into the room.

One popular type of such heating apparatus includes a fan driven by an electric motor, a series of heating elements, a housing enclosing all such elements, and a cover enabling access to the unit after it has been permanently installed. Air passages must be provided in the housing and/or cover to enable a flow of air to be established across the heating elements and to direct the heated air in a widely enough dispersed pattern to enable efficient heating of the room.

Those heaters having a single housing combined with a cover, or heaters having a two piece housing, require that the housing element or housing and cover elements be spatially separated to provide a cavity of sufficient size to enclose the fan motor, heating elements and associated electrical components. The required spatial configuration is often accomplished by using bracket members fastenable to one element to provide mounting points for the second element. This necessarily requires separate assembly steps during construction, since brackets must first be fastened to one element, than aligned to provide mounting points for the second element. Such brackets are often easily bent or dislodged, and have proven to be manifestly inconvenient and costly in terms of assembly time and are particularly frustrating when, during servicing of an already installed unit, the required bracket either become misaligned or lost and reassembly cannot be effected. During the operating life of such heaters, the brackets may loosen to the point that vibration noise is heard whenever the fan motor is running.

The invention herein features, among other things, a housing having upper and lower members which, in a preferred embodiment, have hemispherical bosses formed integrally thereon. The bosses are fixed in location and configuration for positive mating, and the housing is further designed to provide facilitated air flow therethrough.

Accordingly, this invention has the following objects:

To provide two piece housings for electric forced air heating units which require no brackets to maintain a spaced-apart relationship;

To provide such heating units in forms whereby the housing elements, when assembled, define paths for air flow distribution;

To provide such heating units in forms whereby such housing elements having mating surface means providing points of attachment without requiring the use of separate brackets;

To provide such heating units in forms easily and quickly assembled and disassembled; and To provide such heating units with housings minimizing the effects of vibration.

These and further objects will become more apparent upon a consideration of the accompanying drawings in which.

Figure 1:
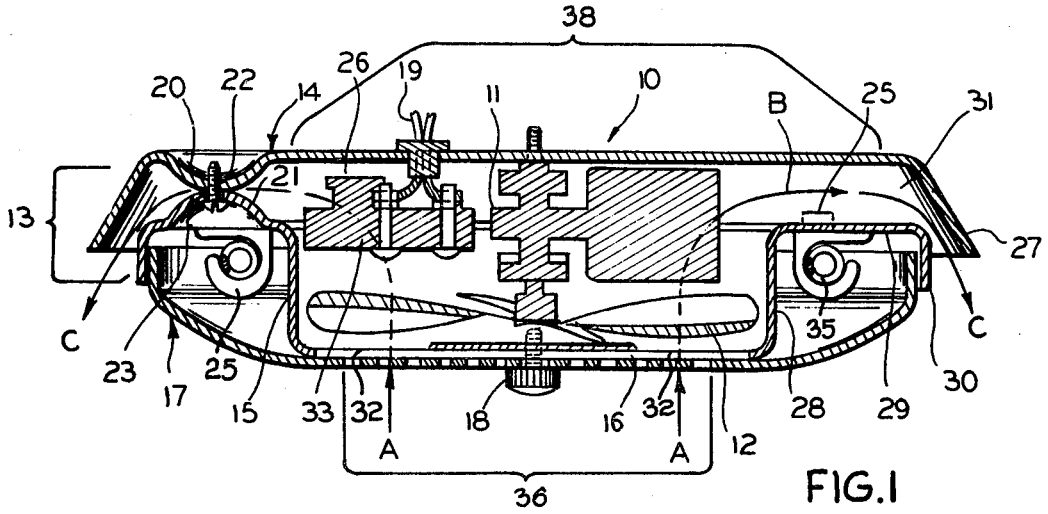
FIG. 1 is a side sectional view of the inventive heating unit.

Consistent with the foregoing objects, Applicant provides an electric fan operated heating unit 10 having an upper housing 14 and a lower housing 15 fastened together at mating bosses 20 and 21 respectively. Upper housing unit 14 and cover unit 17 have disposed therebetween heating element 35 and supports 25 and fan assembly 11 which, when activated, heat air drawn in through cover 17 and disperse the heated air through peripherally extending cavity 31 defined by upper housing 14 and lower housing 15.

Referring now to FIG. 1, the numeral 10 indicates an electric forced air heating unit having an electric motor 11 to which is mounted fan blade assembly 12.

Figure 2:
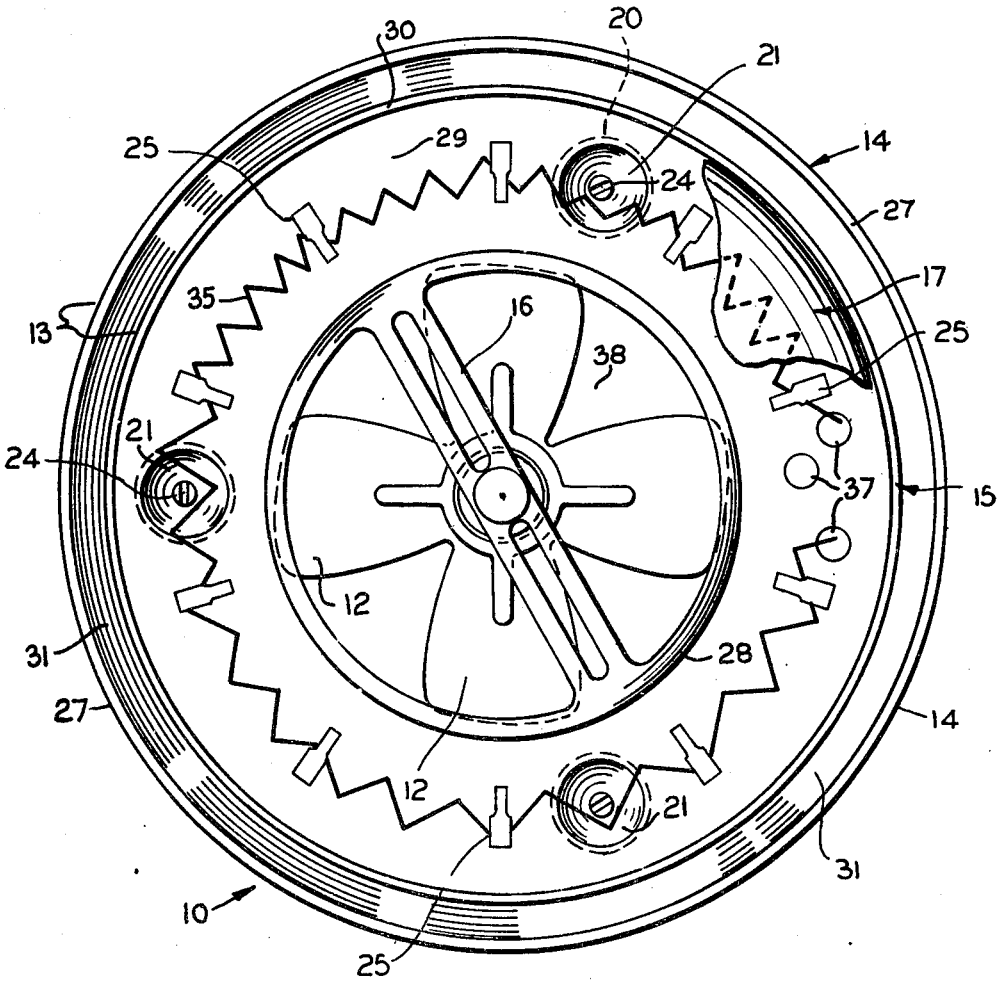
FIG. 2 is a bottom plan view with the cover element removed and with the motor and electrical components omitted to simplify the illustration.

Housing 13 includes upper housing element 14 and lower housing element 15. Upper housing element 14 has flat central portion 38 formed thereon, as indicated in FIGS. 1 and 2. Lower housing element 15 has cross member 16 integrally formed therewith to provide a mounting point for cover 17 which may be secured to cross member 16 by fastener 18. Removal of fastener 18 allows cover 17 to be removed for cleaning purposes. Typically, as installed, housing 13 is fastened directly to the ceiling of a room and is wired in as illustrated at 19 of FIG. 1 in a typical overhead electrical installation.

Upper housing unit 14 and lower housing unit 15 have formed respectively thereon aligned mating bosses 20 and 21. Each boss 20 has tapped aperture 22 formed therethrough, while each boss 21 has aperture 23 formed therethrough to enable boss 20 and boss 21 to be effectively fastened together by threaded fastener 24. Lower housing unit 15 also provides the mounting surface for heating element 35, supported by radially space heating element supports 25. The number and wattage of such elements may be varied to suit particular design and heating requirements. Electrical terminal unit 26 may be arranged in any conventional manner to provide electrical current to heating element 35, as well as to electrical motor unit 11. It should be noted that fan 12, motor 11, terminal assembly 26, heating element 35, and heating element supports 25 are common components of electric heaters. In this preferred embodiment, upper housing unit 14 has a somewhat "pie tin" configuration with wall segment 27 depending outwardly to overlap lower housing unit 15. Lower housing unit 15 has a deep dish portion 28 with a side wall extending laterally, as at 29, then depending, as at 30 to define a passage 32 between wall segments 29 and 30 of lower housing unit 15, and wall segment 27 of upper housing unit 14. Passage 31 extends circumferentially about electric heating unit 10, interrupted only at those sites at which boss 20 and boss 21 abut. Selection of the number of bosses to be included and the sites at which said bosses are to be formed may be varied within required size, mounting, and air flow parameters. However, inclusion of at least three such boss mounting sites is preferred to assure a rigid, vibration-free structure.

Cover element 17 may be provided with a grate-like central configuration 36 to allow passage of air through cover element 17 and through open portions 32 of lower housing element 15 as shown in FIGS. 1 and 2.

Typical construction and operation of heating unit 10 may be illustrated by the following examples. During assembly, electric terminal assembly 26, electric motor assembly 11 and fan assembly 12 are mounted to upper housing unit 14. In a separate operation, heating element 35 is mounted to lower housing unit 15 by supports 25 radially disposed about wall segment 29. Upper housing unit 14 is then fastened to lower housing unit 15 at, respectively, bosses 20 and 21, using fasteners 22. Heating elements 25 are then connected to wiring 19 as, for example, at terminal block assembly 33, through knockout stols 37. Cover unit 17 is then secured to lower housing unit 15 with fastener 18.

When electrical energy is switched on, fan motor 11 and heating element 35 are simultaneously activated. Blades of assembly 12 are angled, and direction of rotation is selected, as an example, to draw air through openings in cover unit 17 as illustrated at A in FIG. 1. Such incoming air is then drawn over the exterior of walls 28, 29, and 30 of housing 15, and thereby above heating element 35 as shown at B and is subsequently expelled and dispersed through annular passage 31 as illustrated at C. In this manner, a continuous supply of warmed air is circulated throughout the room to provide individually controlled warmth much more quickly than would be possible with a conventional centrally situated heating system arranged to heat all rooms. Heating element 35 may also provide a measure of radiated heat, as well.

Mating bosses 20 and 21 are formed in such a manner as to minimize the points of contact between upper housing 14 and lower housing 15 to reduce the possibility of vibration within housing 13, and also to provide quick and convenient access for adjustment, cleaning or repair. Removal of cover element 17 reveals fasteners 22. Removal of fasteners 22 enables removal of lower housing unit 15 exposing all inner elements of heating unit 10 for cleaning, servicing or replacement. Assembly and disassembly may thus be carried out without requiring the indexing of individual bracket units, and reassembly conceals all fasteners save fastener 18 which may be formed in a particularly decorative manner to enhance the assembled appearance of heating unit 10. Thus, lower housing unit 15 is provided with secure points of attachment to upper housing unit 14 while providing minimal disturbance of the air flow pattern through annular cavity 31. Such minimal points of contact and such minimal disturbance of air flow is accomplished in this embodiment by forming bosses 20 and 21 in a somewhat hemispherical configuration thereby presenting no sharp or abrupt surfaces to complicate or disturb the flow of heated air.

While the foregoing has presented a specific embodiment of the invention claimed herein, it is to be understood that this embodiment is presented by way of example only. It is expected that others in the art will perceive variations which, while differing from the foregoing, do not depart from the spirit and scope of the invention.

I claim:

1. A forced circulation air heater having an electric heating element, an electrically operated fan, and a housing for said fan and heating element, said housing comprising:

an upper housing member, said upper housing member including a central disk portion, said disk portion terminating in an outwardly depending wall segment extending peripherally about said disk portion, said disk portion having formed integrally thereon and protruding axially downwardly therefrom a plurality of first convex dome-like bosses;

a lower housing member, said lower housing member having a plurality of second convex dome-like bosses formed integrally thereon and protruding axially upwardly therefrom, said first and second bosses having substantially the same wall thickness, respectively, as said disk portion and said lower housing member respectively, said first and second bosses being positioned respectively to tangentially abut when said upper housing member is attached to said lower housing member at those points whereat said first and second bosses respectively abut;

means to secure said first and second bosses together at said points;

said upper housing member being shaped and dimensioned to overlap said lower housing member in spaced relation thereto, said upper and lower housing members thereby defining therebetween a peripherally extending passage whereby air may be directed therethrough by said electrically operated fan.

2. The apparatus as recited in claim 1 wherein each of said first bosses includes a first aperture, each of said second bosses includes a second aperture;

said means to secure including a fastener for each pair of mated first and second bosses, and said fastener securing said first and second bosses one to the other by passage through said first and second apertures.

3. The apparatus as recited in claim 1 wherein said upper housing member and said lower housing member are substantially circular.

4. The apparatus as recited in claim 1 wherein said housing means further includes a cover securable to said lower housing member, said cover shaped and dimensioned to overlap said bosses when in place.

5. The apparatus as recited in claim 1 wherein said housing means includes three said first bosses and three said second bosses, respectively, said first and second bosses being positioned to space said upper and lower housing members apart when said bosses are mated.

6. The apparatus as recited in claim 1 wherein said fan draws a stream of ambient air into said housing and expels said air stream therefrom after said air stream has been heated;

said heating element being attached to said lower housing, out of said passage, and thereby out of said air stream.

* * * * *

UNITED STATES PATENT AND TRADEMARK OFFICE

CERTIFICATE OF CORRECTION

PATENT NO. : 4,146,776

DATED : March 27, 1979

INVENTOR(S) : Robert Johansen

It is certified that error appears in the above-identified patent and that said Letters Patent are hereby corrected as shown below:

| | |
|---|---|
| Col. 2, line 42 | "space" should be --spaced--. |
| Col. 2, line 57 | "32" should be --31--. |
| Col. 3, line 14 | "stols" should be --slots--. |

Signed and Sealed this

*Thirty-first* Day of *July 1979*

[SEAL]

*Attest:*

*Attesting Officer*

LUTRELLE F. PARKER

*Acting Commissioner of Patents and Trademarks*